US005934891A

United States Patent [19]

Pelto-Huikko

[11] Patent Number: 5,934,891

[45] Date of Patent: Aug. 10, 1999

[54] CONSTANT LEAKAGE FLOW, PULSATION FREE SCREW PUMP

[75] Inventor: Raimo Pelto-Huikko, Vantaa, Finland

[73] Assignee: Kone Oy, Helsinki, Finland

[21] Appl. No.: 08/667,850

[22] Filed: Jun. 20, 1996

[30] Foreign Application Priority Data

Jun. 22, 1995 [FI] Finland ..... 953152

[51] Int. Cl.[6] ..... F01C 1/08

[52] U.S. Cl. ..... 418/197; 418/150; 418/201.1

[58] Field of Search ..... 418/201.1, 197, 418/196, 201.3, 150

[56] References Cited

U.S. PATENT DOCUMENTS

| | | | |
|---|---|---|---|
| 2,165,963 | 4/1939 | Curtis | 418/150 |
| 2,652,192 | 9/1953 | Chilton | 418/150 |
| 2,922,377 | 1/1960 | Whitfield . | |
| 3,086,474 | 4/1963 | Sennet . | |
| 4,018,549 | 4/1977 | Segerström . | |
| 5,051,077 | 9/1991 | Yanagisawa et al. | 418/201.1 |
| 5,123,821 | 6/1992 | Willibald et al. | 418/197 |
| 5,350,286 | 9/1994 | Kisi et al. | 418/150 |

FOREIGN PATENT DOCUMENTS

| | | | |
|---|---|---|---|
| 496170 | 7/1992 | European Pat. Off. . | |
| 4107315 | 9/1991 | Germany | 418/197 |
| 448235 | 6/1936 | United Kingdom . | |

*Primary Examiner*—Charles G. Freay
*Assistant Examiner*—Cheryl J. Tyler
*Attorney, Agent, or Firm*—Birch, Stewart, Kolasch & Birch, LLP

[57] ABSTRACT

The screw pump (1) has a driving screw (6) and at least one side screw (7), which are placed in a screw channel (5) in the pump body (2), between a suction space (3) and a pressure space (4). At least one of the clearances between the surfaces of the driving screw, side screws and screw channel is larger in the areas close to the suction and pressure spaces than the corresponding clearance in the middle portion of the pump channel. The magnitude of the clearances is so fitted that the total leakage flow (V) between the suction and pressure spaces through the clearances is substantially the same for all angles of rotation of the screws (6,7). Preferably the clearance fit is achieved by reducing the diameter of the screw at its ends so that the change in the external diameter of the reduced portion has at least two different values.

25 Claims, 4 Drawing Sheets

CONSTANT LEAKAGE FLOW, PULSATION FREE SCREW PUMP

FIELD OF THE INVENTION

The present invention relates to a screw pump with a driving screw and at least one side screw with the screws being placed in a screw channel in the pump casing between a suction space and a pressure space.

DESCRIPTION OF THE BACKGROUND ART

The pumps used in hydraulic elevators are almost exclusively screw pumps. An important reason for this is that screw pumps have good power and volume transmission characteristics. Especially in elevator drives, but also in other applications, the pressure pulsations produced by the pump are a problem. In screw pumps, the pressure pulse level is fairly low. However, even this low pressure pulse level generates noise and vibration in the hydraulic circuit, requiring investments to damp these, thereby increasing the costs. If undamped, the noise and vibration have a disturbing effect at least on elevator passengers and possibly other people as well, once the noise or vibration has propagated further away from the pump via the building structures, air or hydraulic circuit. The pressure pulses also have a negative effect on the pump, hydraulic circuit and other equipment to which the pressure pulses or the vibrations they produce are conducted.

In a screw pump, pressure pulsation is caused by two significant factors, viz. compressibility of the oil and variation of leakage flow in the pump. The variation in leakage flow depends on the variation in the tightness of the pump during the pumping cycle; in other words, the number of chambers formed between the pump screws and therefore also the total number of sealings between chambers varies while the screws are being rotated. Thus, high pressure conditions occur at intervals. On the other hand, compressibility results in pressure pulsation when the space between the pump screws opens at the pressure end of the pump and the pressure difference is suddenly levelled out, leading to a momentary drop in the pressure delivered by the pump. In order to eliminate the pressure pulsation or at least to reduce it to a level where it would be insignificant enough to allow it to be ignored in the design of the hydraulic circuit or other constructions, e.g. the structures of a hydraulic elevator, it would be necessary to solve both the pressure pulsation problem resulting from compressibility of oil and the pressure pulsation problem resulting from leakage flow. Previously known screw pump solutions, however, do not eliminate pressure pulsation completely or even nearly completely.

From German patent specification no. 4107315, a screw pump is known which has a driving screw and at least one side screw. Both the driving screw and the side screw are placed in the casing enclosing the screws between a pressure space and a suction space. The screw end on the pressure side is tapered. The screw tapers by a factor of max. 0.4 over a distance corresponding to the screw pitch. The tapering angle is below 10°. The tapering is designed to achieve gradual and defined opening of the pressure-side chamber. In this way, the pressure pulsation and the resulting pulsation of the flow are clearly reduced, but still a pressure pulsation of significant magnitude remains.

SUMMARY OF THE INVENTION

To meet the need to improve the screw pump and achieve a substantially pulsation-free screw pump, a new type of screw pump and a screw pump screw are presented as an invention. The screw pump of the invention is characterized by a pump casing, a driving screw and at least one side screw, the driving screw and at least one side screw being rotatable, the casing having a suction space, a pressure space and a screw channel therebetween, said screws being placed in the screw channel in the pump casing between the suction space and the pressure space, at least one of the clearances between the surfaces of the driving screw, side screws and screw channel being larger in areas closer to the suction and pressure spaces than a corresponding clearance in a middle portion of the screw channel, and magnitude of the clearances being fitted so that total leakage flow through the clearances between the suction and pressure spaces is substantially the same for all angles of rotation of the screws. The screw pump screw of the invention is characterized by the screw pump driving a casing with a screw channel, a suction space and a pressure space, the screw channel being between the suction space and the pressure space, the screw extending in a longitudinal direction and being placed in the screw channel in the pump casing between the suction space and the pressure space, said screw comprising end portions and a middle portion therebetween, the end portion of the screw being thinner than the middle portion, the reduced portion of the screw having a length and an external diameter with a change in the external diameter of the reduced portion of the screw for a unit of length in the longitudinal direction of the screw being at least two different values within the length of the reduced portion.

The advantages achieved by the invention include the following:

The pump of the invention is easy to manufacture.

With a simple change in the construction of the screw and/or screw channel of the screw pump, a pump producing practically no pressure pulsation is achieved.

As no pressure pulsation occurs in the pump, there is no need to consider the disturbances produced by pressure pulsation, and this allows savings in the structures and components designed to insulate and damp the noise and vibration generated by the elevator and its hydraulics.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of a few application examples, which in themselves do not constitute a limitation of the invention. Reference is made to the following drawings, in which.

DETAILED DESCRIPTION OF THE PREFERRED EMBODIMENT

Figure 1:
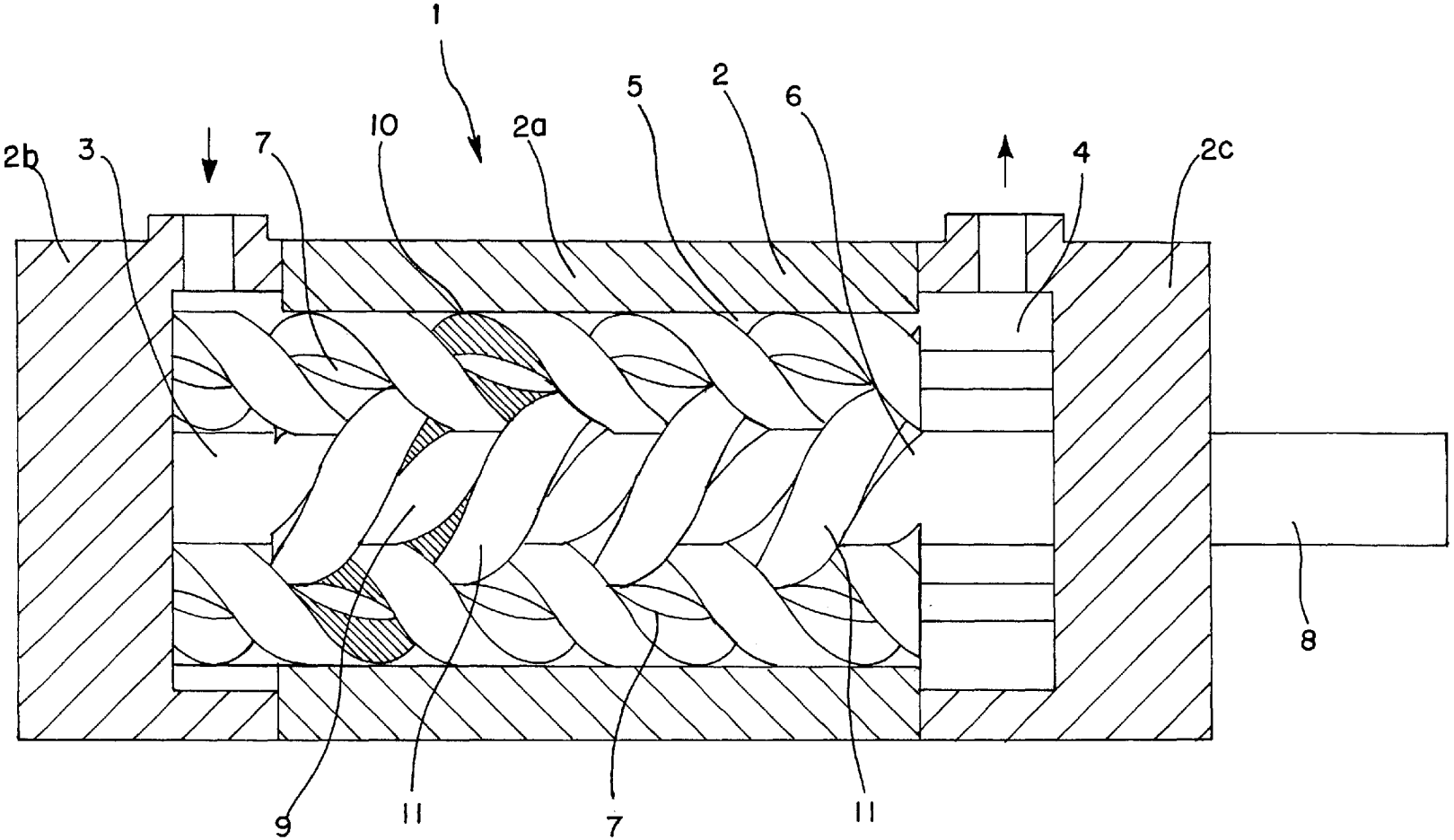
FIG. 1 presents a screw pump in sectional view.

FIG. 1 presents a screw pump 1 in longitudinal section. The casing 2 of the screw pump encloses a suction space 3, a pressure space 4 and a screw channel 5 between these, with a driving screw 6 and side screws 7 placed in the channel. The casing 2 consists of a middle part 2*a* containing the screw channel, and suction side and pressure side end blocks 2*b* and 2*c*. The operating power for the pump is transmitted to the driving screw 6 by means of the driving screw spindle 8, which is rotated by an electric motor or other drive unit. While rotating, the driving screw causes the side screws to rotate. As they rotate, the screws 6,7 enclose oil in their spiral grooves. Between the screws 6,7 and the screw channel wall 10, so-called chambers 9 are formed. As the pump is running, these chambers move from the suction space 3 towards the pressure space 4, into which they finally open.

Figure 3:
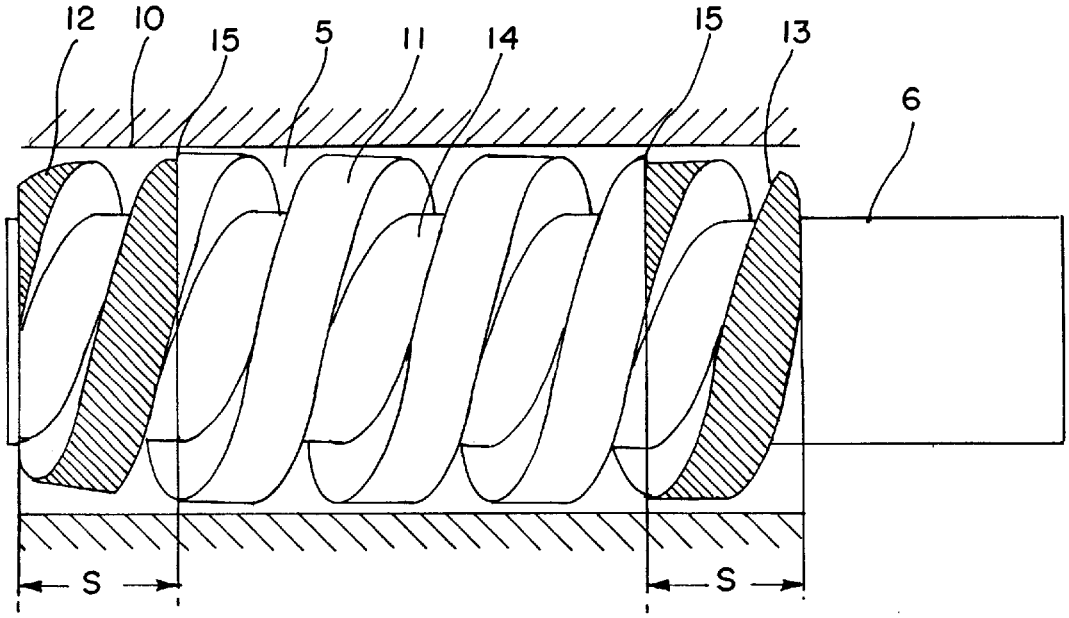
FIG. 3 presents another screw of a pump of the invention, the screw being shown in the screw channel.

One or more of the clearances between the driving screw 6, side screws 7 and screw channel wall 10 is larger in the areas closer to the suction and pressure spaces than the corresponding clearances in the middle portion of the pump channel. The size of the clearances has been so fitted that the total flow resistance to the leakage flow through the clearances between the pressure space 4 and suction space 3 is substantially the same for all positions of the angle of rotation of the screws 6,7. Because the resistance to the leakage flow is constant, the leakage flow is also constant. The change in the clearances is preferably so fitted that the pressure differences between the suction space and the closing chamber and, on the other hand, between the pressure space and the opening chamber change in a linear fashion in relation to the chamber advance, in other words, the pressure differences at the ends of the screw change linearly in relation to the movement of the screw. The clearance by means of which the leakage flow is adjusted and which is changed in the lengthwise direction of the pump is preferably the clearance between the screw channel wall 10 and the screw crest 11 of at least one screw 6,7. In the present context, this clearance is also called 'radial clearance'. Reference is also made to FIG. 3.

Since the clearances are rather small, it will be advantageous in respect of manufacture to provide only one clearance of changing magnitude. In this case, it will be preferable to select the clearance between the screw channel wall 10 and the screw crest 11 of the driving screw 6. The clearance between the screw channel wall 10 and the screw crest 11 of the driving screw 6 is present in each chamber. The total flow is adjusted by means of the clearance between the driving screw 6 and the wall 10 of the screw channel 5 by increasing the clearance towards the ends of the screw channel 5 in the screw channel portions at each end of the screw channel. The length of the portion with increasing clearance at each end is about equal to the length of the chamber 9, in other words, in the case of a double-threaded screw, about 0.4 . . . 0.65 times the pitch of the driving screw. Due to the difficult geometry of the chambers, the most suitable length of increasing clearance has to be established via practical measurements. A preferred starting point is that the clearance is increased over a distance corresponding to the chamber length, i.e. half the pitch of the driving screw.

Figure 2A:
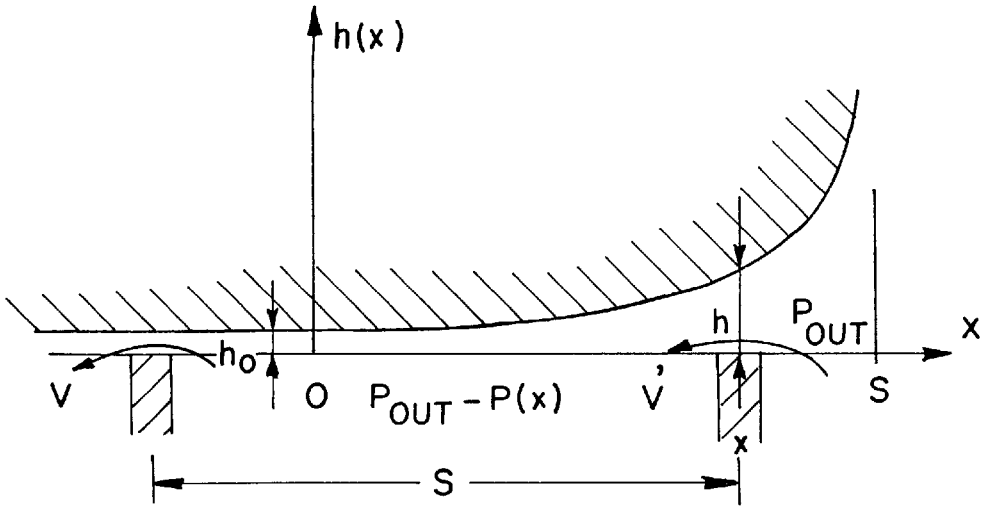
FIGS. 2A, 2B illustrate the flow and pressure conditions between chambers connected via the clearances.
Figure 2B:
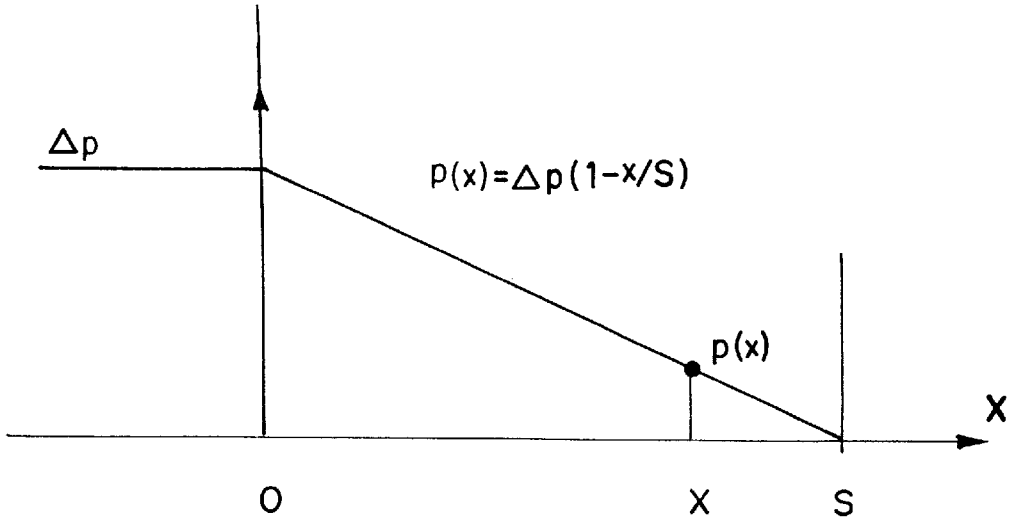

FIGS. 2A and 2B illustrate the change in the clearance between the channel wall and the flanges moving in a channel with a trumpet-mouthed opening and the corresponding pressure difference p(x) between the output pressure $p_{out}$ and the pressure ($p_{out}$−p(x)) prevailing in the chamber that opens into the output pressure when the value of the clearance h changes from the value ho to a value at which the chamber is completely opened. In this case the chamber is the space enclosed by the flanges and the channel wall between themselves. The flanges in FIG. 2A correspond to the screw threads. The model presented in FIG. 2A is designed to visualize the discussion of the topic. Visualization using flanges provides in a simple manner an idea of a screw with zero pitch, in which the phenomena arising from the thread geometry are not present and thus cannot complicate the discussion. Of the flanges, only the upper portion is presented, and only a part of the sectioned channel is shown. The clearance h increases through a distance equal to the chamber length S. In the example in FIG. 2, only the radial clearance has an effect. If the resistance to leakage flow in the clearance is exclusively due to viscose flow resistance and only the leakage flow occurring across the crest of the flange has an importance with respect to the total magnitude of leakage flow, then a suitable increase in the clearance will be of the form $$h/h_0 = \sqrt[3]{\frac{1}{1-x}}$$

On the other hand, if the flow resistance were regarded as being exclusively due to the inertia of mass, then the increase in the clearance would be of the form $$h/h_0 = \sqrt{\frac{1}{1-x}}$$

FIG. 3 presents the driving screw 6 of a pump of the invention, shown in a screw channel 5. The driving screw 6 has been made thinner at its ends. This reduction in screw thickness has been effected by reducing the height of the screw thread so as to increase the clearance between the screw channel wall 10 and the screw crest 11 of the driving screw 6. In the middle portion 14 of the screw along its length, the clearance is substantially constant. The end portions 12,13 of the driving screw are thinner in diameter than its middle portion 14. The change in the external diameter of the reduced end portions 12,13 for a unit of length in the longitudinal direction of the screw has at least two different values within the length S of the reduced end portions 12,13. From the point of view of adjusting the total flow resistance regarding leakage flow in the pump to a substantially constant value, it will be advantageous to implement the change in the clearance in such a way that the change in the reduction of the external diameter of the reduced portion of the screw takes place continuously through at least part of the length of the reduced end portions 12,13. The screw diameter has been reduced at both ends of the screw over a length corresponding to the length of a chamber, i.e. half the screw pitch.

The beginning of the reduced portion of the driving screw is implemented by introducing an abrupt reduction in the screw diameter, so that a step 15 appears between the middle portion 14 and the reduced end portions 12,13. This makes it possible to achieve an accurate timing of the change in pressure difference resulting from the reduction at each end of the screw. The change in pressure difference occurs in the desired form right from the beginning of the reduced portion. The screw with tapered ends may also be one of the other screws except the driving screw. In FIG. 3, the crest 11 of the screw thread in each of the reduced portions is in the area indicated by lengths S.

Figure 4:
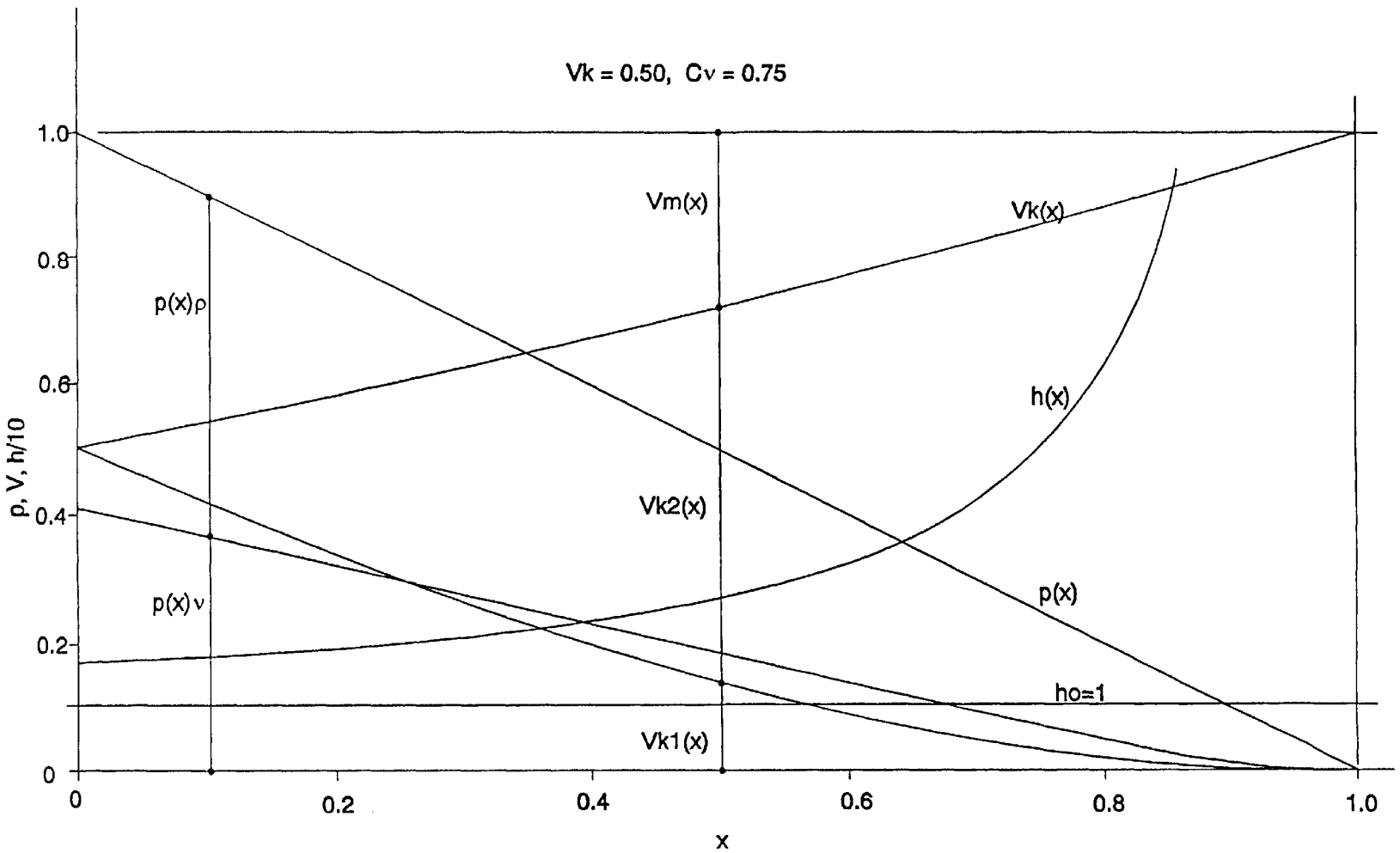
FIG. 4 illustrates the change in the radial clearance in the pump of the invention and the corresponding changes in the pressure difference and leakage flow terms.

FIG. 4 illustrates the change in the radial clearance in the pump of the invention and the corresponding change in the pressure difference over a distance corresponding to about one chamber length, or half the screw pitch, at the pressure end of the screw pump. The horizontal axis represents the position x in the endmost screw portion of a length equalling one chamber length S within a range of 0–1. The vertical axis indicates the relative radial clearance h(x), in other words, the radial clearance is expressed in relation to the constant clearance ho in the middle portion of the screw, this constant clearance being represented by the value 1. In the figure, h(x) has been drawn on a scale of 1:10. The pressure difference p(x) prevailing in the clearance across the screw crest, i.e. in the radial clearance, is presented in relation to the pressure difference Δp across the constant clearance $h_0$. Thus, the pressure difference p(x)=Δp when the increase in the clearance has not yet started in the chamber, and p(x)=0 when the chamber has completely opened into the pressure space. With a suitable form of the clearance, the pressure difference p(x) changes linearly from the value Δp to the value 0 over the distance of one chamber length S.

The leakage flow in the clearances of the screw pump can be described as follows:

$$V=V_k^{+}V_m=1$$

where V is the total leakage flow, $V_k$ is the leakage flow through the radial clearance and $V_m$ is the sum of all other leakage flows.

The pressure difference Δp is described by the formula $$\Delta p=\Delta p_v^{+}\Delta p_p=1$$

which means that the pressure difference is the sum of the pressure loss terms produced by the viscosity resistance to the leakage flow and the acceleration loss of the oil mass. For the total leakage flow V and the pressure difference Δp, the numeric value 1 is used. These losses depend on the flow and the clearance as follows $$\Delta p_v \sim Vlh^3$$

and $$\Delta p_p \sim (Vlh)^2$$

We can write $$\Delta p_v = C_v \cdot \Delta p$$

so $$\Delta p_p = (1-C_v)\cdot \Delta p$$

where $C_v$ is a coefficient representing the influence of viscosity resistance in the model.

In practice, the first design criterion regarding tightness, e.g. in elevator pumps, will be the effect of viscose flow resistance. This is the case in our example pump as well, where $C_v$ is 0.75. In the middle portion of the pump, where the radial clearance is $h_0$, the viscose resistance is generally more decisive. This is also the case in the pump presented as an example, in which $C_v$= 0.75. However, the situation is different in those parts of the pump where the clearance has been enlarged. In the pump in this example, $p(x)_v$ is clearly lower in the portions of increased clearance than elsewhere. In addition, the increase in the size of the clearance has to be based on a consideration of how the leakage flow is distributed among the clearance across the crest 11 of the driving screw and the other clearances. In a situation where the chamber has nearly opened into the pressure space, leakage flow occurs almost exclusively across the crest 11 of the driving screw, i.e. through the radial clearance, whereas in a chamber with a lesser degree of opening, the proportion of the flow occurring through other clearances is significant.

In the example pump presented in FIG. 4, $C_v$ is 0.75, which means that in the middle portion of the pump, where the radial clearance is $h_0$, 75% of the pressure loss in the sealing between successive chambers is caused by viscosity resistance and only 25% by inertia. The sum of successive pressure losses is the pressure difference between the chambers. Going from the middle pump portion beyond the point x=0, i.e. towards the end of the pump across the step 15, at which the radial clearance jumps up from the value $h_0$ to h(0), the proportion of pressure loss resulting from viscosity resistance falls to the value $p(0)_v$. Correspondingly, the proportion of the pressure loss term caused by the acceleration of the mass of the oil quantity flowing in the radial clearance increases to the value $p(0)_p$. As the clearance changes according to the curve h(x), when x increases from the value 0 to the value 1, the pressure difference p(x) falls from the value 1 to the value 0. In a preferred case, the reduction in the pressure difference occurs in a linear fashion. As the clearance h(x) increases, the proportion p(x)v in the pressure difference p(x) due to viscosity resistance decreases while the proportion $p(x)_p$ in the pressure difference p(x) of the pressure loss term due to acceleration of mass increases. In other words, as the clearance h(x) increases, $p(x)_v$ decreases faster than $p(x)_p$. The leakage flow in the opening chamber is considered in terms of two component flows, $V_m(x)$ and $V_k(x)$. $V_k(x)$ is the leakage flow through the radial clearance, and $V_m(x)$ is the leakage flow through the other clearances. $V_k(x)$ can be further divided into two subcomponents $V_{k1}(x)$ and $V_{k2}(x)$ . $V_{k1}$ is that part of the leakage flow $V_k(x)$ which flows through a clearance of size $h_0$, whereas $V_{k2}(x)$ is that part of the leakage flow $V_k(x)$ which flows through a clearance of size $h(x)>h_0$. In a situation where X=0, the front edge of the chamber is reaching the area x>0, where the radial clearance is still $h_0$ throughout the length of the chamber and $V_k(x)=V_{k1}(x)$ and $V_{k2}(x)=0$. When x increases from this value, the size of the passage available for the leakage flow in the radial clearance increases. As x increases, an increasing proportion of the leakage flow passes through the radial clearance while the leakage flow $V_m(x)$ through the other clearances decreases. At the same time, the leakage flow component $V_{k2}(x)$ flowing through the enlarged radial clearance naturally also increases. When the endmost chamber has completely opened into the pressure space, i.e. when x=1, the value of $V_k(x)=V_k(1)=1$ and the entire leakage flow is flowing in the enlarged radial clearance.

Curves corresponding to those in FIG. 4 can also be drawn to describe the process at the suction end of the screw. Only the rise in the pressure difference and the change in the clearance would be the mirror images of the decrease in pressure difference and change in clearance presented in FIG. 4.

A model for a screw pump can be so designed that the value of the radial clearance h(x) can be determined. In the model, the radial clearance in the middle portion of the pump, where the pressure increase mainly occurs, is ho. The value of $h_0$ in a typical screw pump used in elevators is 0.01 . . . 0.03 mm. In this presentation, the $h_0$ value used is 1. As a starting point, the leakage flow in the model is non-pulsating, i.e. the total leakage flow is constant. On the horizontal axis, position x is presented as having values between 0–1 to describe the endmost chamber length of the screw. When x=0, a new chamber arrives into the endmost chamber length, and when x=1, this chamber has just completely opened into the pressure space. When x=0, h(x) begins to increase, at first by a jump from the value $h_0$ to the value h(0).

In the model presented, the screw pump is characterized by a gradual and linear decrease of the pressure difference during the transition from the endpoint x=0 of the constant radial clearance $h_0$ to the situation x=1 where the chamber has been completely opened. The pressure difference as a function of x can be written as follows $$\Delta p(x)=C_v V_m(x)/V_m+(1-C)[V_m(x)/V_m)]^2=1-x$$

and therefore the leakage flow through the other clearances except the radial clearance behaves as follows $$\frac{V_m(x)}{V_m}=\frac{-C_v+\sqrt{C_v^2+4(1-C_v)(1-x)}}{2(1-C_v)}$$

Thus, to describe the leakage flow through the radial clearance, the following formula is obtained $$V_k(x)=1-V_m(x)=1-V_m\frac{-C_v+\sqrt{C_v^2+4(1-C_v)(1-x)}}{2(1-C_v)}$$

Since $$V_k(x)=V_{k1}(x)+V_{k2}(x)$$

and $$\Delta p_v=C_v\cdot\Delta p$$

then it is possible to write $$V_{kl}(x)=V_k\cdot(1-x)\frac{-C_v+\sqrt{C_v^2+4(1-C_v)(1-x)}}{2(1-C_v)}$$

Since $$V_k(x)=V_{kl}(x)+V_{k2}(x)=1-V_m(x)$$

then it follows that $$V_{k2}(x)=1-V_m\frac{-C_v+\sqrt{C_v^2+4(1-C_v)(1-x)}}{2(1-C_v}-V_k\cdot(1-x)\frac{-C_v+\sqrt{C_v^2+4(1-C_v)(1-x)}}{2(1-C_v)}$$

When $V_{k2}$ is written as $$V_{k2}(x)=p_v(x)\frac{V_k}{C_v}\int_0^x h^3(x)dx$$

and

-continued $$V_{k2}(x)=\sqrt{p_p(x)}\,\frac{V_k}{1-C_v}\int_0^x h(x)dx$$

this yields $$p_v(x)=V_{k2}(x)\frac{C_v}{V_k}\cdot\frac{1}{\int_0^x h(x)^3dx}$$

and $$p_p(x)=\left(V_{k2}(x)\cdot\frac{\sqrt{1-C_v}}{V_k}\cdot\frac{1}{\int_0^x h(x)dx}\right)^2$$

Since $$p_v(x)+p_p(x)=1-x$$

this yields $$p_v(x)=V_{k2}(x)\frac{C_v}{V_k}\cdot\frac{1}{\int_0^x h(x)^3dx}$$

and $$p_p(x)=\left(V_{k2}(x)\cdot\frac{\sqrt{1-C_v}}{V_k}\cdot\frac{1}{\int_0^x h(x)dx}\right)^2$$

Since $$p_v(x)+p_p(x)=1-x$$

we finally obtain the equation $$V_{k2}(x)\frac{C_v}{V_k}\cdot\frac{1}{\int_0^x (h(x))^3dx}+\left(V_{k2}(x)\cdot\frac{\sqrt{1-C_v}}{V_k}\cdot\frac{1}{\int_0^x h(x)dx}\right)^2=1-x$$

from which h(x) can be solved e.g. by numeric methods. The curve h(x) in FIG. 4 is an example of such a solution.

A preferred embodiment is so implemented that at each end the shape of the screw produces linearly changing pressure changes such that, as the pressure difference across the screw crest in the suction end increases, the pressure difference across the screw crest in the pressure end correspondingly decreases. Preferably the sum of these pressure differences is a constant value, which is the same as the pressure difference across the screw crest in the middle portion of the screw.

It is obvious to a person skilled in the art that the embodiments of the invention are not restricted to the examples described above, but that they may instead be varied in the scope of the claims presented below.

For instance, a solution having two successive tapered sections at each end of the screw, the sections with the larger taper angle being located at the extreme ends of the screw, will produce a clearly lower pressure pulsation than previously known screw pumps.

It is further obvious to the skilled person that although, from the point of view of manufacture, an advantageous method for implementing the change in the clearance at the ends of the screw channel to adjust the leakage flow is to taper the screw in its end parts, there are also other possibilities to implement the adjustment of leakage flow, e.g. by enlarging the screw channel in its end portions or by increasing the clearances between the screws. Similarly, it is obvious that in practice the clearances are shaped on the basis of typical operating conditions of the pump. In selecting the shaping of the clearances, the aim is to adjust the useful operating point consistent with the pump ratings in such a way that the effect of temperature changes e.g. on the viscosity of the oil will cause only slight changes in the operation of the pump.

Consistent with the idea of the invention is also a solution in which the portion with an enlarged clearance extends through a length one chamber length larger than in the example. However, a pump like this will be inferior in respect of tightness and pressure increase capacity.

I claim:

1. A screw pump comprising a pump casing, a driving screw and at least one side screw, the driving screw and the at least one side screw being rotatable, the casing having a suction space, a pressure space and a screw channel therebetween, said screws being placed in the screw channel in the pump casing between the suction space and the pressure space, a first bore for the driving screw and a second bore for the at least one side screw, the first and second bores being rotationally symmetric and forming the screw channel, at least one of the clearances between the surfaces of the driving screw, side screws and screw channel being larger in areas closer to the suction and pressure spaces than a corresponding clearance in a middle portion of the screw channel, and magnitude of the at least one clearance being fitted so that total leakage flow between the suction and pressure spaces is substantially the same for all angles of rotation of the screws.

2. The screw pump as defined in claim 1, wherein the pressure space and an opening into the screw channel are fitted such that pressure differences at the end of at least one of the screws change linearly between the screw channel and the pressure space in a downstream direction of the channel.

3. The screw pump as defined in claim 1, wherein the suction space and a closing from the screw channel are fitted such that pressure differences at the end of at least one of the screws chance linearly between the suction space and screw channel in a downstream direction of the channel.

4. The screw pump as defined in claim 1, wherein at least one of total leakage flow and change in pressure difference is adjusted by the clearance between the driving screw and the wall of the screw channel.

5. The screw pump as defined in claim 1, wherein the clearance adapting the total leakage flow increases toward ends of the screw channel in screw channel portions at each end of the screw channel, the length of said screw channel portions being in the range of 0.4 to 0.65 times the pitch of the driving screw thread.

6. The screw pump as defined in claim 5, wherein the length of the screw channel portions is half the pitch of the driving screw thread.

7. The screw pump as defined in claim 1, wherein the pump is a hydraulic oil pump.

8. The screw pump as defined in claim 1, wherein the screw channel has a generally constant diameter between the suction space and the pressure space.

9. The screw pump as defined in claim 1, wherein a diameter of at least one of the side screw and the driving screw decreases at least at one end thereof.

10. The screw pump as defined in claim 1, wherein both ends of the at least one screw have a reduced diameter relative to a middle portion of the at least one screw.

11. A driving screw or side screw for a screw pump, the screw pump having a casing with a screw channel, a suction space and a pressure space, the screw channel being between the suction space the pressure space, the screw extending in a longitudinal direction and being placed in the screw channel in the pump casing between the suction space and the pressure space, said screw comprising end portions and a middle portion therebetween, the end portions of the screw being thinner than the middle portion, the end portions of the screw having a length and an external diameter with a rate of change in the external diameter of the end portions of the screw for a unit of length in the longitudinal direction of the screw being at least two different values within the length of the end portions.

12. The screw as defined in claim 11, wherein at least over part of the length of the end portions of the screw, the change in the external diameter changes continuously along the longitudinal direction of the screw.

13. The screw as defined in claim 12, wherein the screw has a portion of reduced diameter at each end extending through a distance equal to a length of a chamber.

14. The screw as defined in claim 11, wherein a reduction in the diameter of the screw occurs abruptly so that a step is formed in a longitudinal section of the screw between the middle portion and at least one of the end portions of the screw.

15. The screw as defined in claim 11, wherein the screw is the driving screw and wherein the end portions of the driving screw are tapered.

16. A screw pump comprising a pump casing, a driving screw and at least one side screw, the driving screw and the at least one side screw being rotatable, the casing having a suction space, a pressure space and a screw channel therebetween, said screws being placed in the screw channel in the pump casing between the suction space and the pressure space, the screw channel having an end which is generally planar, at least one of the clearances between the surfaces of the driving screw, side screws and screw channel being larger in areas closer to the suction and pressure spaces than a corresponding clearance in a middle portion of the screw channel, and magnitude of the at least one clearance being fitted so that total leakage flow between the suction and pressure spaces is substantially the same for all angles of rotation of the screws, at least one of total leakage flow and change in pressure difference being adjusted by the clearance between the driving screw and the wall of the screw channel.

17. The screw pump as defined in claim 16, wherein the pressure space and an opening into the screw channel are fitted such that pressure differences at the end of at least one of the screws change linearly between the screw channel and the pressure space in a downstream direction of the channel.

18. The screw pump as defined in claim 16, wherein the suction space and a closing from the screw channel are fitted such that pressure differences at the end of at least one of the screws change linearly between the suction space and screw channel in a downstream direction of the channel.

19. The screw pump as defined in claim 16, wherein the clearance adapting the total leakage flow increases toward ends of the screw channel in screw channel portions at each end of the screw channel, the length of said screw channel portions being in the range of 0.4 to 0.65 times the pitch of the driving screw thread.

20. The screw pump as defined in claim 19, wherein the length of the screw channel portions is half the pitch of the driving screw thread.

21. The screw pump as defined in claim 16, wherein the screw channel has a generally constant diameter between the suction space and the pressure space.

22. The screw pump as defined in claim 16, wherein a diameter of at least one of the side screw and the driving screw decreases at least at one end thereof.

23. The screw pump as defined in claim 16, wherein both ends of the at least one screw have a reduced diameter relative to at middle portion of the at least one screw.

24. The screw pump as defined in claim 16, wherein the pump is a hydraulic oil pump.

25. The screw pump as defined in claim 16, wherein both ends of the screw channel are generally planar.

* * * * *